US005275332A

United States Patent [19]

Heuberger et al.

[11] Patent Number: 5,275,332

[45] Date of Patent: Jan. 4, 1994

[54] CARDBOARD BOX FOR POURABLE MATERIAL, IN PARTICULAR LIQUIDS

[75] Inventors: Erich Heuberger, Trugenhofen; Michael Fuchs, Dischingen; Manfred Hoffmann, Königsbronn; Peter Krekow, Zöschingen; Thomas Rössle, Aislingen; Ernst Wöhrle, Heidenheim, all of Fed. Rep. of Germany

[73] Assignee: Carl Edelmann GmbH, Heidenheim, Fed. Rep. of Germany

[21] Appl. No.: 973,408

[22] Filed: Nov. 9, 1992

[51] Int. Cl.[5] ..... B65D 5/54; B65D 5/70

[52] U.S. Cl. ..... 229/216; 220/416; 220/462

[58] Field of Search ..... 229/215, 216, 217, 219, 229/125.42; 220/416, 418, 462, 463

[56] References Cited

U.S. PATENT DOCUMENTS

| | | | |
|---|---|---|---|
| 2,959,336 | 11/1960 | Mosse et al. | 220/462 |
| 3,339,820 | 9/1967 | Krzyzanowski | 229/216 |
| 3,367,553 | 2/1968 | Francis | 229/217 |
| 3,416,717 | 12/1968 | Beck, Jr. et al. | 220/462 |
| 3,578,234 | 5/1971 | Marchisen | 220/462 |
| 4,032,060 | 6/1977 | Bergstein | 220/462 |
| 4,245,743 | 1/1981 | Heuberger | 229/217 |
| 4,478,351 | 10/1984 | Homma | 220/463 |

FOREIGN PATENT DOCUMENTS

| | | | |
|---|---|---|---|
| 706248 | 3/1965 | Canada | 220/462 |
| 2302484 | 8/1973 | Fed. Rep. of Germany | 229/216 |
| 1494682 | 9/1967 | France | 229/217 |
| 2092545 | 8/1982 | United Kingdom | 220/462 |

*Primary Examiner*—Gary E. Elkins

*Attorney, Agent, or Firm*—Brooks Haidt Haffner & Delahunty

[57] ABSTRACT

Described is a cardboard box package having an inner bag and wherein three of four top cover flaps are integrally interconnected, with the intermediate one of said cover flaps extending from a side face of the box being folded to the shape of a triangle and folded down onto the top face of the cardboard box. The inner bag has its sealed upper end portion partially passed between the cover flaps and locally bonded thereto. Outwards folding of the triangularly folded cover flap and tearing a section of the inner bag end portion off permits a pouring spout to be formed and the package to be thereby opened (FIG. 1).

10 Claims, 6 Drawing Sheets

CARDBOARD BOX FOR POURABLE MATERIAL, IN PARTICULAR LIQUIDS

Figure 1:
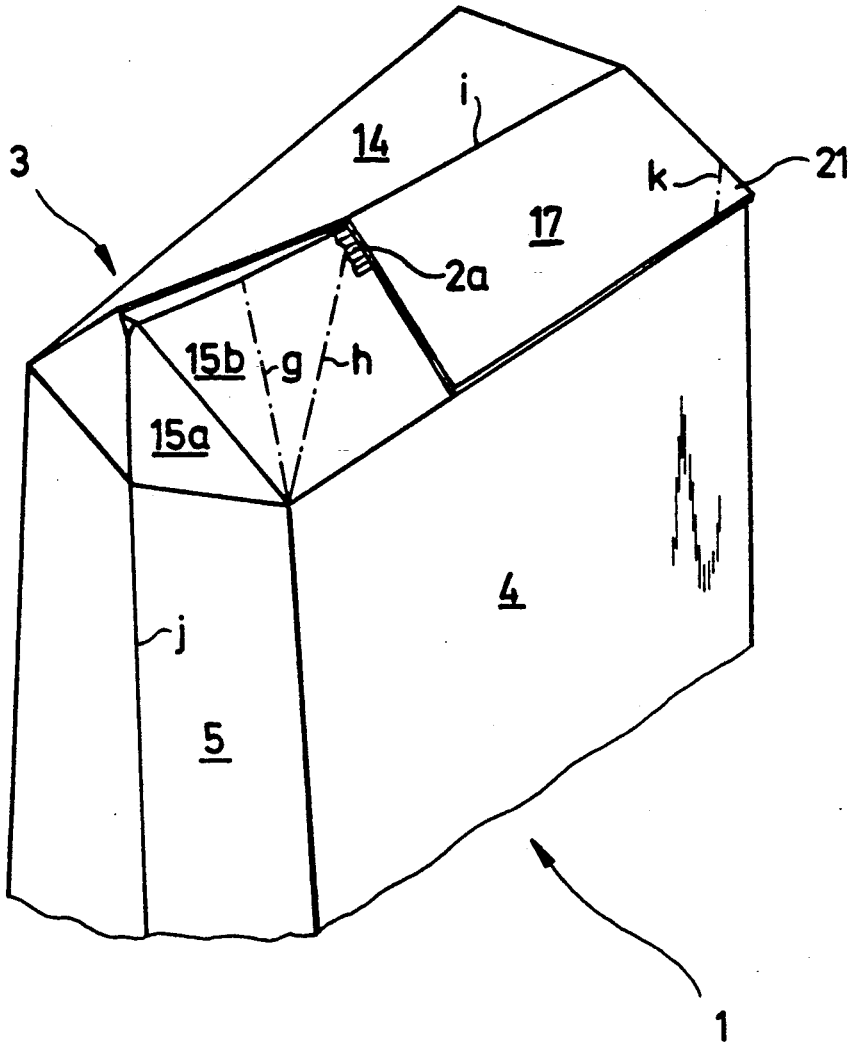

The invention relates to a cardboard box for pourable material, in particular liquids, consisting of a folding box having a rectangular base section and made of cardboard, and an inner bag of a heat-sealable material disposed in the box and adhesively secured thereto at least at a number of separate locations.

With regard to packing materials for certain liquids, such as detergent concentrates, there is a trend induced by environment protection considerations to increasingly turn away from pure plastic packing materials in favour of cardboard packages in combination with thin plastic sheeting, for containing liquids to be decanted by the user into a bottle for subsequent piecemeal consumption.

There have already been developed cardboard packing materials provided with an inner bag made of a aroma-protective plastic material and having a pouring spout projecting through a cutout in the cardboard box surrounding the inner bag (DE Patent 33 36 269). The production and manipulation of these packing materials is rather onerous. Since cardboard packages are usually supplied to the filling plant in a flattened-down state, and since a pouring spout attached to the inner bag does not, however, permit the package to be laid flat, the pouring spout can only be attached at the filling plant after the package has been unfolded. The supply of packaging materials of this type to the filling plant is thus hampered by logistic problems.

Known from DE Patent 26 47 025 is a cardboard box with an inner bag, which can be supplied to the filling plant in a prefabricated state, i.e. with the inner bag in place, and in the flattened-down configuration, and which in the unfolded and filled state is of a configuration permitting the inner bag to be opened and at the same time a pouring spout to be formed by tearing off a portion of a cover flap together with a portion of the inner bag. This package comprises an inner cover flap acting to close the folding box at its upper end and formed with a transversely extending slot for the sealed end portion of the inner bag to extend therethrough, so that in the closed state of the folding bag the sealed end portion of the inner bag lies partially below and partially above the inner cover flap; the outer cover flap overlies the inner cover flap and is adhesively secured thereto as well as to the portion of the upper end section of the inner bag overlying the inner cover flap. At the location whereat it overlies the last-named portion of the upper end section of the inner bag, the outer cover flap is formed with a tear perforation permitting it to be torn off together with the respective portion of the inner bag. The specifically incorporated provisions are effective to safely retain the inner bag in place as the package is torn open, to thereby facilitate this opening operation.

It is an object of the invention to provide a cardboard box for pourable material, in particular liquids, which is of simple construction, capable of being produced, set up, filled and closed in a simple manner, and which lends itself to being opened by the consumer in an uncomplicated operation.

This object is attained according to the present invention by a cardboard box package consisting of a folding box made of cardboard and having a rectangular base section, and an inner bag made of a tubular section of a heat-sealable material disposed within said folding box and adhesively secured thereto at least at a number of separate locations, said inner bag having two sealed end portions and completely occupying the inner space of said folding box, said folding box comprising a body with two oppositely disposed main faces and two side faces interconnecting said main faces, the four body faces being each provided at one of their ends with inwards folded bottom flaps partially glued to one another and cooperating to form a bottom of said folding box, the other ends of said body faces carrying first to fourth cover flaps defined by a circumferential crease line and cooperating to form an upper closure of said folding box, wherein the first and third cover flaps extending from said main faces are integrally connected via respective crease lines to the second cover flap extending from one (the first) side face, the fourth cover flap extending from the other (the second) side face has at least its side adjacent said third cover flap formed with an oblique boundary continuously extending from the end of the section of said circumferential crease line interconnecting said fourth cover flap and said second side face, said cover flaps are of a height corresponding to about half the width of a side face, said second cover flap is formed with two obliquely extending crease lines extending from the ends of said crease line connecting it to said first side face to a common apex so as to define a first isosceles right-angled triangle, the two portions of said second cover flap lying outside said first triangle are likewise formed as second and third isosceles right-angled triangles of about half the size of said first triangle and folded thereonto along said obliquely extending crease lines, one of said sealed end portions of said inner bag passes between said first and third cover flaps and overlies said first cover flap, said inner bag is formed above said body of said folding box with gusset portions acting as boundaries of said sealed end portion and adhesively secured to said second and fourth cover flaps, one of said gusset portions being additionally enclosed between said first and said second and third triangles of said second cover flap and adhesively secured thereto, and the sealed end portion adjacent this gusset portion passing between adjacent sides of said second and third triangles, said fourth cover flap is folded onto said first cover flap together with the gusset portion of said inner bag secured thereto, said third cover flap is folded onto said fourth cover flap, said second cover flap is folded onto said first and third cover flaps and releasably adhesively secured thereto, with said second and third triangles thereof folded onto said first triangle with said gusset portion of said inner bag enclosed therebetween, and said third cover flap is provided with an adhesive tab at least partially covering said fourth cover flap, partially covering said first cover flap and adhesively secured thereto.

Advantageous implementations of the invention are set forth in the subclaims.

The invention thus provides a package which lends itself to be readily manufactured, filled and closed by mechanical means. The lower end of the package can be closed in the conventional manner by inwards folding of flaps extending from the body faces of the folding box, after its inner bag has been sealed at this location.

The characterizing features of the invention are particularly concerned with the upper end of the package, which is configured in a manner permitting the package to be filled, sealed, closed, and at a later time, opened in a simple manner, with the particular advantage that the closed cardboard package as a whole is of a strictly parallelepipedic configuration facilitating its being stacked and packed in large-volume containers. After having been emptied of its contents, the components of the packes can be readily separated from one another for subsequent reclamation.

Figure 2:
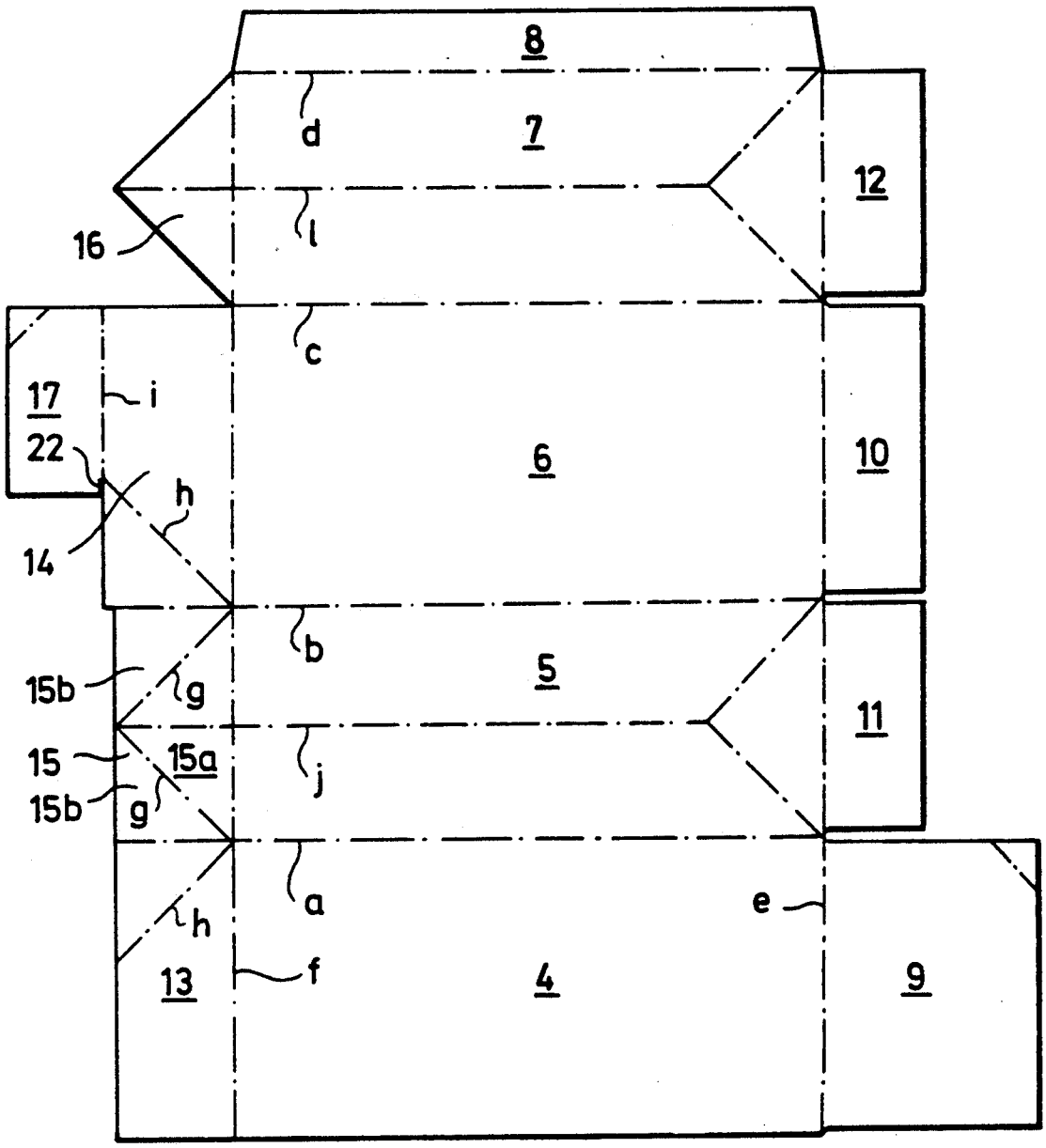

An embodiment of the invention shall now be described by way of example with reference to the accompanying drawings, wherein:

FIG. 1 shows the upper portion of a cardboard box package according to the invention after having been opened preparatory to its contents being decanted, FIG. 2 shows a blank cutting of a folding box, and FIGS. 3 to 6 illustrate the upper portion of the package in consecutive steps during the closing operation.

The cardboard box packing comprises a substantially parallelepipedic folding box 1 and an inner bag 2 (cf. FIG. 4) made of a tubular section of a heat-sealable material having both of its ends sealed and being disposed within folding box 1, FIG. 1 showing only a small part of a sealed upper end portion 2*a* of inner bag 2. FIG. 1 shows the cardboard box package in its opened state ready for having its contents decanted, with one of its cover flaps being set up so as to form a pouring spout 3, the part of sealed end portion 2*a* associated to pouring spout 3 having been torn off to thereby open inner bag 2.

For better understanding of the construction of folding box 1, reference is made to FIG. 2. The blank cutting of folding box 1 comprises first and second main faces 4 and 6 and first and second side faces 5 and 7, the latter being narrower than main faces 4 and 6, with first side face 5 disposed between main faces 4 and 6, and second side face 7 being laterally connected to main face 6. Extending from second side face 7 is a glueing flap 8 destined for connection to first main face 4. The main and side faces are defined by crease lines a to d extending therebetween as indicated by dash-dotted lines.

In the set-up state, in which gluing flap 8 is adhesively secured to first main face 4, main faces 4 and 6 and side faces 5 and 7 cooperate to form a folding box body. Extending from one end of each main and side face 4 to 7 are respective bottom flaps 9 to 12 connected thereto at a circumferential crease line e, the bottom flap 9 extending from first main face 4 being of a dimension, as measured in the longitudinal direction of the rectangular main face 4, substantially corresponding to the width of a side face 5 or 7, respectively, as measured transversely of said longitudinal direction. In the set-up and completely adhesively bonded state of folding box 1, bottom flaps 9 to 12 are folded inwards along the crease line e connecting them to the folding box body, with bottom flap 10 extending from second main face 6 overlying the bottom flaps 11 and 12 extending from the side faces, and the bottom flap 9 extending from first main face 4 overlying bottom flap 10 and adhesively secured thereto.

At the other, i.e. the upper end of the folding box body, main and side faces 4 to 7 are extended by first to fourth cover flaps 13 to 16 connected to the respective main and side faces along a circumferential crease line f. In the embodiment shown, the first and third cover flaps 13 and 14 extending from first and second main faces 4 and 6, respectively are integrally connected to the cover flap 15 extending from first side face 5, along respective extensions of crease lines a and b. Third cover flap 14 has a gluing tab 17 extending therefrom. Second cover flap 15 is formed with two obliquely extending crease lines g defining within the area of cover flap 15 a first isosceles rectangular triangle 15*a* the hypothenuse of which is formed by the section of crease line f connected second cover flap 15 to first side face 5. At the same time oblique crease lines g separate a second and a third isosceles right angled triangle 15*b* from first triangle 15*a*, the former being each half the size of the latter. The fourth cover flap 16 of the present embodiment has the shape of a fourth isosceles triangle, the base line of which is the section of crease line f connecting fourth cover flap 16 to second side face 7. Fourth cover flap may in fact also be of trapezoidal shape, it being however, imperative, for reasons to be explained later on, that the side of fourth cover flap 16 adjacent third cover flap 14 extends at an oblique angle.

Cover flaps 13 to 16 have a maximum height corresponding to half the width of a side face 5 or 7, respectively.

First and third cover flaps 13 and 14 are each formed with crimp lines h extending at an angle of 45° with respect to crease line f and terminating at the corners of the folding box body whereat main faces 4, 6 join first side face 5.

The characteristics of the cardboard box package will become evident from the following description of the manner in which it is set up, filled and closed.

The cardboard box package may be supplied to the filling plant in a flat-lying and pre-glued state, with gluing tab 8 adhesively bonded to first main face 4, and a tubular sheet section of a length greater than that of main and side faces 4 to 7 disposed therebetween. Both ends of this tubular sheet section are still open, and the tubular sheet section is adhesively secured to the folding box blank at least at a number of separate locations.

With particular advantage the tubular sheet section is glued to first, second and fourth cover flaps 13, 15 and 16, to thereby facilitate handling of the folding box in the set-up operation and for closing of the cardboard box package after the filling operation.

The pre-bonded, flat-lying folding box blank is unfolded to the shape of a pipe body of rectangular cross-sectional configuration. Subsequently bottom flaps 9 to 12 are folded outwards, so that the lower end of the tubular sheet section projecting from the rectangular pipe body can be sealed. The thereby resulting gusset portions adjacent the corners of the sealed end portion are folded back into the folding box. Subsequently the bottom flaps are folded inwards, at first bottom flaps 11 and 12, and thereafter bottom flaps 10 and 9 in the specified sequence, bottom flap 9 being then adhesively secured to bottom flap 10. This operation is carried out in the conventional manner and does not require any further explanation, for which reason it is not illustrated in the drawings.

The cardboard box package may now be filled in the upright position. Subsequently first and third cover flaps 13 and 14 are folded inwards, and fourth cover flap 16 is folded outwards. As first and third cover flaps 13 and 14 are folded inwards, second cover flap 15 is deflected outwards, while at the same time second and third triangles 15*b* come to rest on first triangle 15*a*. As a result of the tubular sheet section being bonded to the first, second and third cover flaps, the tubular sheet section automatically assumes a favourable configuration for its being sealed in response to the cover flaps being brought to the position shown in FIG. 3.

Figure 3:
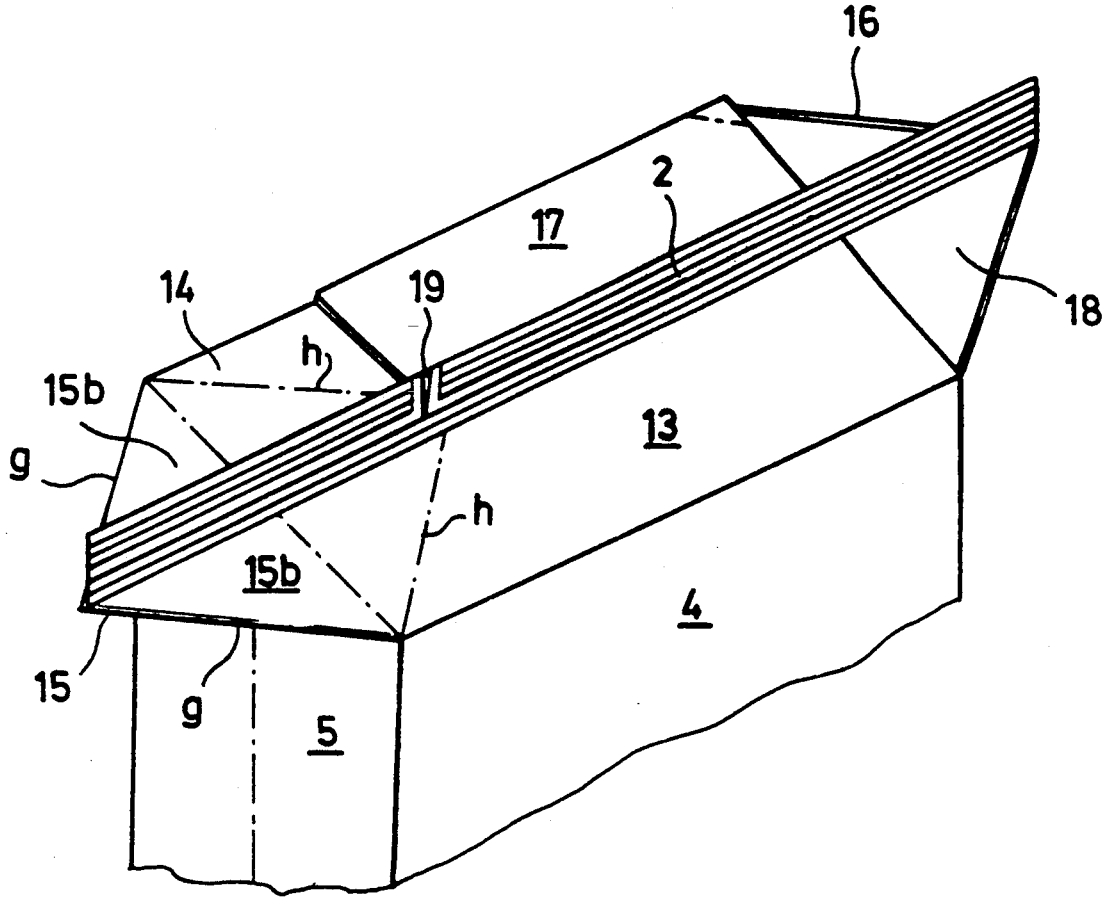

Glueing tab 17 is now laid down onto third cover flap 14, so that the upper end portion 2 of the inner bag is then freely accessible for the welding jaws of a closing appliance. The resulting state after the formation of the sealing weld seam is depicted in FIG. 3. Simultaneously with the sealing operation, the sealing weld seam at the end portion 2*a* may be formed with a cut 19 adjacent the end of bonding tab 17 and in the vicinity of the location whereat the end of second cover flap 15 is to be disposed at a later time.

Figure 4:
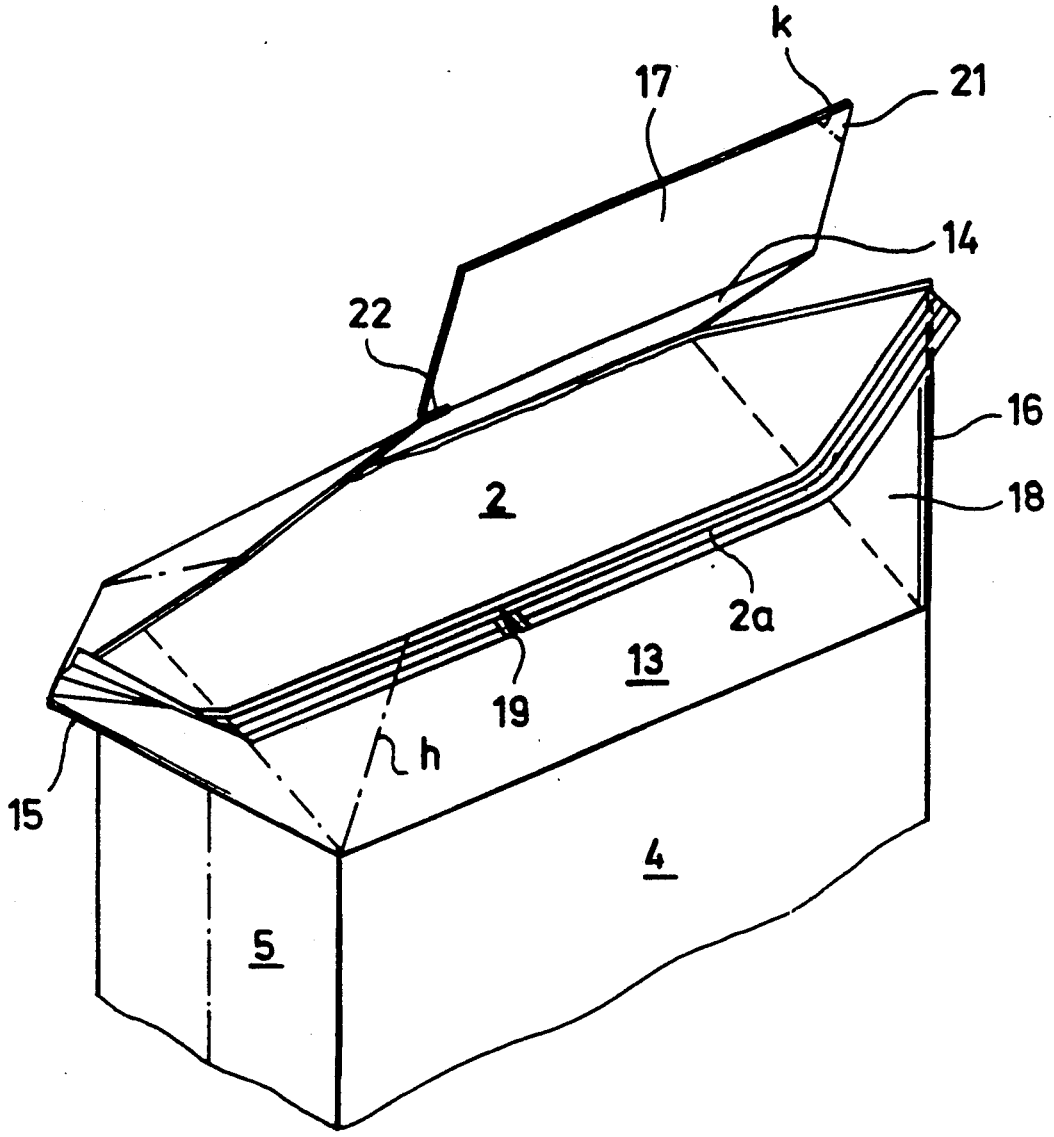

Subsequently, and as shown in FIG. 4, third cover flap 14 with bonding tab 17 is raised, this being made possible by its not being adhesively bonded to the closed inner bag 2. Fourth cover flap 16 is then folded inwards together with the gusset portion 18 of inner bag 2 bonded thereto, so that it comes to rest on first cover flap 13. This inwards folding of fourth cover flap 16 is made possible by its oblique edge at the side adjacent third cover flap 14. Subsequently third cover flap 14 is again folded down so that it comes to rest substantially coplanar with first cover flap 13. This state has been illustrated in FIG. 5.

Second cover flap 15 is then folded down onto the top face of folding box 1, together with the gusset portion of inner bag 2 enclosed between its triangles 15*a* and 15*b*, and releasably bonded to first and third cover flaps 13 and 14, whereupon bonding tab 17 is adhesively secured to first cover flap 13. The resulting final state has been illustrated in FIG. 6.

The operation of adhesively securing bonding tab 17 to first cover flap 13 is facilitated by providing fourth cover flap 16 in a triangular shape as illustrated in the present example, wherein it is formed with an oblique edge also on its side facing away from third cover flap 14.

Figure 6:
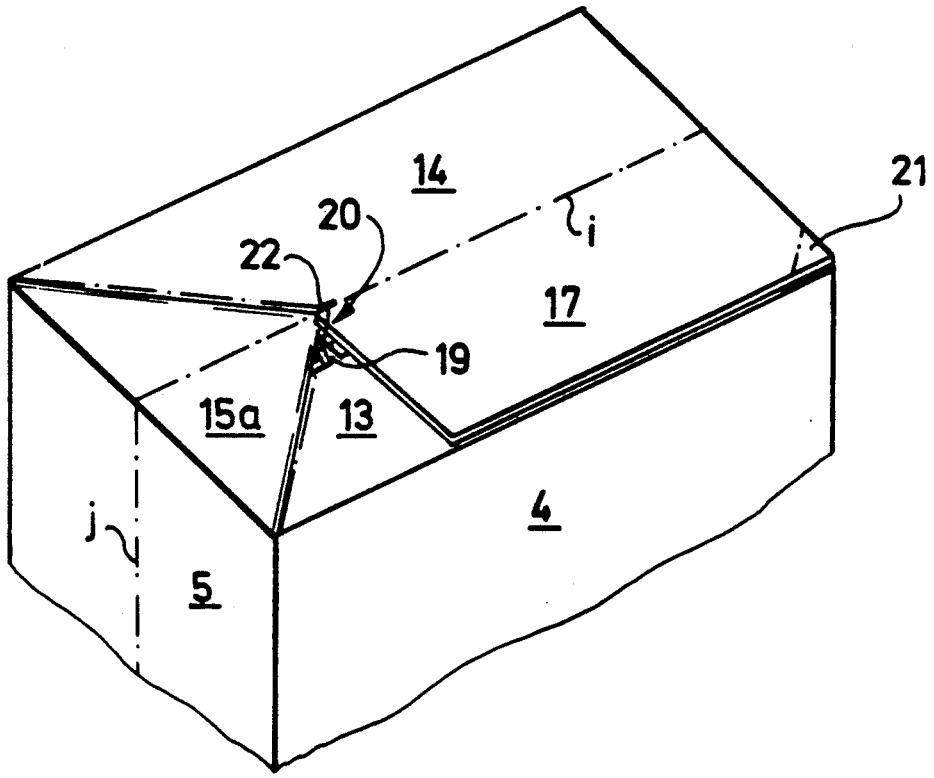

FIG. 6 also shows that an edge portion of bonding tab 17 overlies the apex of first triangle 15*a* of second cover flap 15 at a location indicated at 20. This is helpful to retain the end portion of second cover flap 15, and offers the possibility of reclosing the cardboard box package after having been opened and partially emptied. A cut 22 adjacent the boundary portion at 20 is effective to separate this portion from first cover flap 13, to thereby permit the boundary portion to be readily bent upwards at 20 for opening and reclosing the pouring spout 3 formed by second cover flap 15.

Bonding tab 17 is preferably connected to third cover flap 14 along a crimp line i. In addition, first side face 5 is advantageously formed with a crimp line j extending right into second cover flap 15.

Figure 5:
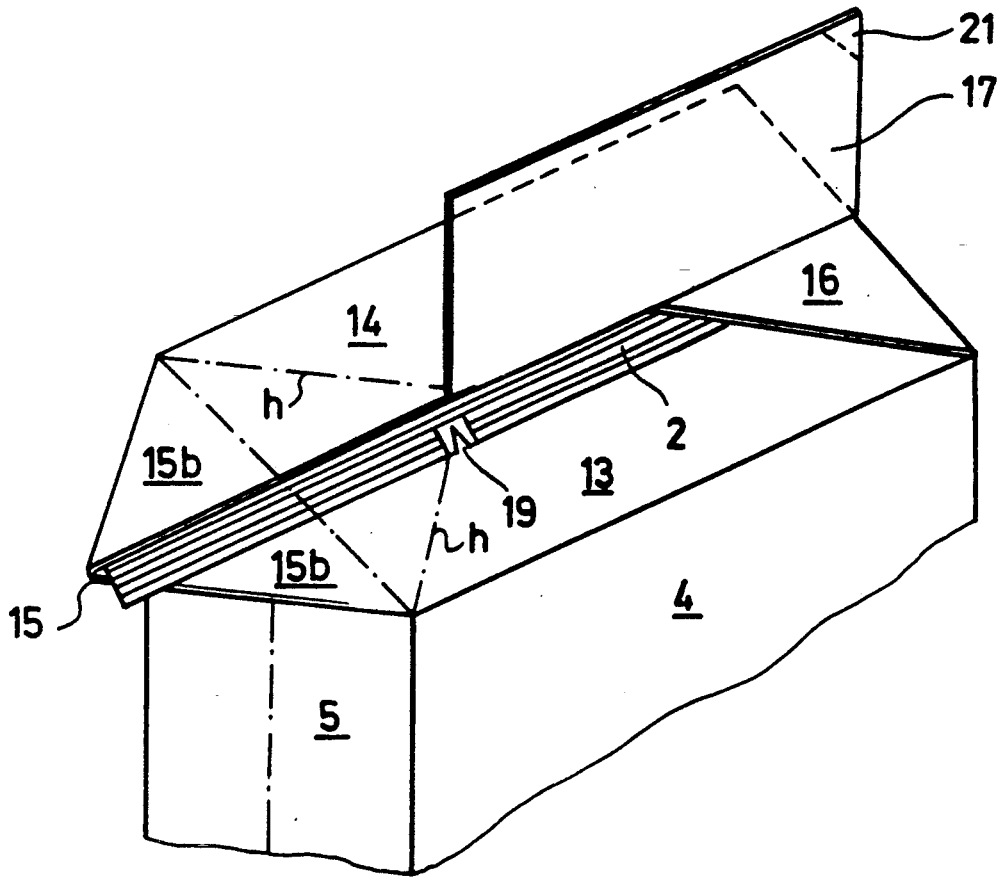

For opening the cardboard box package, second cover flap 15 is pulled out from underneath boundary portion 20 of bonding tab 17, at the same time releasing the adhesive bond of triangles 15*b* of second cover flap 15 to first and third cover flaps 13 and 14, whereupon second cover flap 15 is folded outwards to a position approximately corresponding to the one according to FIG. 5, without, however, releasing the adhesive bond of bonding tab 17 to first cover flap 13. Inner bag 2 may now be torn at the cut 19 of its end portion 2*a* whereupon the section of the sealed end portion 2*a* extending to the end of cover flap 15 can be torn off the inner bag, the clean separation of this section of the end portion 2*a* being facilitated by the support offered to this section of the end portion 2*a* by the edges of third cover flap 14 and one of the triangles 15*b* of second cover flap 15 and by the adhesive bonding of inner bag 2 to second and third triangles 15*b*, particularly in view of the fact that the inner bag 2 is prevented from yielding by these adhesive bonds.

When folding box 1 is now laterally compressed adjacent second cover flap 15, the latter assumes an erected position as shown in FIG. 1 to result in the formation of a pouring spout 3. This formation of the pouring spout 3 is facilitated by the obliquely extending crimp lines h formed in first and third cover flaps 13 and 14.

After the package has been completely emptied, the folding box can be fully opened, to which purpose the adhesive bond of bonding tab 17 to first cover flap 13 is released. This is facilitated by the provision of a non-adhesive corner 21 of bonding tab 17 defined by a crimp line k. After folding box 1 has thus been fully opened, inner bag 2 can be torn out by virtue of its adhesive bonds to the cardboard of folding box 1 being readily releasable. Folding box 1 may then be pressed flat, this operation being facilitated by the already mentioned crimp line j in second side face 5 and a similar crimp line 1 in fourth side face 7 (FIG. 2).

It should finally be mentioned that the inner bag may advantageously made of a material such as an aluminum-paper laminate, with the aluminum layer facing inwards and coated with polyethylene as a sealing material. Other sealable materials may also be suitably employed, depending on the nature of the product to be packed.

We claim:

1. A cardboard box for pourable material, consisting of a folding box defining an inner space and made of cardboard and having a rectangular base section, and an inner bag made of a tubular section of a heat-sealable material disposed within said folding box and adhesively secured thereto at least at a number of separate locations, said inner bag having two sealed end portions and completely occupying the inner space of said folding box, said folding box comprising a body with two oppositely disposed main faces and first and second side faces having a width and interconnecting said main faces, the four body faces each having two opposite ends and being each provided at one of their ends with inwards folded bottom flaps partially bonded to one another and cooperating to form a bottom of said folding box, the other ends of said body faces carrying first to fourth cover flaps defined by a circumferential crease line and cooperating to form an upper closure of said folding box, wherein:

the first and third cover flaps extending from said main faces are integrally connected by respective crease lines to the second cover flap extending from the first side face, the fourth cover flap extending from the second side face has at least a side adjacent said third cover flap formed with an oblique boundary continuously extending from an end of a section of said circumferential crease line interconnecting said fourth cover flap and said second side face, said cover flaps are of a height corresponding to about half the width of a side face, said second cover flap is formed with two obliquely extending crease lines extending from ends of a portion of said circumferential crease line connecting said second cover flap to said first side face to a common apex so as to define a first isosceles right-angled triangle and two portions of said second cover flap lying adjacent said first triangle and likewise formed as second and third isosceles right-angled triangles of about half the size of said first triangle and folded thereonto along said obliquely extending crease lines, so that opposing sides of said second and third triangles are formed, one of said sealed end portions of said inner bag passes between said first and third cover flaps and overlies said first cover flap, said inner bag is formed above said body of said folding box with two gusset portions acting as boundaries of said sealed end portion and adhesively secured to said second and fourth cover flaps, a first one of said gusset portions being additionally enclosed between said first and said second and third triangles of said second cover flap and adhesively secured thereto, said gusset having a sealed end portion passing between said opposing sides of said second and third triangles, said fourth cover flap together with the second gusset portion of said inner bag adhesively secured thereto is folded onto said first cover flap, said third cover flap is folded onto said fourth cover flap, said second cover flap is folded onto said first and third cover flaps and releasably bonded thereto, with said second and third triangles thereof folded onto said first triangle with said gusset portion of said inner bag enclosed therebetween, and said third cover flap is provided with an adhesive tab at least partially covering said fourth cover flap, partially covering said first cover flap and adhesively bonded thereto.

2. A cardboard box according to claim 1, wherein said fourth cover flap has the shape of a triangle.

3. A cardboard box according to claim 1 or 2, wherein said adhesive tab has a boundary portion overlying a free end of said second cover flap.

4. A cardboard box according to claim 3, wherein said boundary portion of said adhesive tab is separated by a cut from said third cover flap.

5. A cardboard box according to claim 1 or 2, wherein a crimp line is disposed between said third cover flap and said adhesive tab.

6. A cardboard box according to claim 1 or 2, wherein said side faces are formed with longitudinally extending crimp lines.

7. A cardboard box according to claim 6, wherein said second cover flap is formed with a crimp line extending as a bisector through the apex of said first triangle.

8. A cardboard box according to claim 1 or 2, wherein the sealed end portion of said inner bag overlying said first cover flap is formed with a cut extending from an edge of said sealed end portion transversely thereinto at a location adjacent a free end of said second cover flap.

9. A cardboard box according to claim 1 or 2, wherein said first and third cover flaps are formed with crimp lines inclined at an angle of 45° and extending parallel to and below the obliquely extending crease lines of said second cover flap.

10. A cardboard box for pourable material, consisting of a folding box defining an inner space and made of cardboard and having a rectangular base section, and an inner bag made of a tubular section of a heat-sealable material disposed within said folding box and adhesively secured thereto at least at a number of separate locations, said inner bag having two sealed end portions and completely occupying the inner space of said folding box, said folding box comprising a body with two oppositely disposed main first and second and side faces having a width and interconnecting said main faces, the four body faces each having two opposite ends and being each provided at one of their ends with inwards folded bottom flaps partially bonded to one another and cooperating to form a bottom of said folding box, the other ends of said body faces carrying first to fourth cover flaps defined by a circumferential crease line and cooperating to form an upper closure of said folding box, wherein:

the first and third cover flaps extending from said main faces are integrally connected by respective crease lines to the second cover flap extending from side face, the fourth cover flap extending from the second side face has at least a side adjacent said third cover flap formed with an oblique boundary continuously extending from an end of a section of said circumferential crease line interconnecting said fourth cover flap and said second side face, said cover flaps are of a height corresponding to about half the width of a side face, said second cover flap is formed with two obliquely extending crease lines extending from ends of a portion of said circumferential crease line connecting said second cover flap to said first side face to a common apex so as to define a first isosceles right-angled triangle and two portions of said second cover flap lying adjacent said first triangle and likewise formed as second and third isosceles right-angled triangles of about half the size of said first triangle and folded thereonto along said obliquely extending crease lines, so that opposing sides of said second and third triangles are formed, one of said sealed end portions of said inner bag passes between said first and third cover flaps and overlies said first cover flap, said inner bag is formed above said body of said folding box with two gusset portions acting as boundaries of said sealed end portion and adhesively secured to said second and fourth cover flaps, a first one of said gusset portions being additionally enclosed between said first and said second and third triangles of said second cover flap and adhesively secured thereto, said gusset portion having a sealed end portion passing between said opposing sides of said second and third triangles, said fourth cover flap together with the second gusset portion of said inner bag adhesively secured thereto is folded onto said first cover flap, said third cover flap is folded onto said fourth cover flap, said second cover flap is folded onto said first and third cover flaps and releasably bonded thereto, with said second and third triangles thereof folded onto said first triangle with said gusset portion of said inner bag enclosed therebetween, said third cover flap is provided with an adhesive tab at least partially covering said fourth cover flap, partially covering said first cover flap and adhesively bonded thereto, wherein a crimp line is disposed between said third cover flap and said adhesive tab, wherein said side faces are formed with longitudinally extending crimp lines, said second cover flap is formed with a crimp line extending as a bisector through the apex of said first triangle, and said first and third cover flaps are formed with crimp lines inclined at an angle of 45° and extending parallel to and below the obliquely extending edges of said second cover flap.

* * * * *